US009359887B2

(12) United States Patent
Miller, II et al.

(10) Patent No.: US 9,359,887 B2
(45) Date of Patent: Jun. 7, 2016

(54) RECOVERABLE DATA ACQUISITION SYSTEM AND METHOD OF SENSING AT LEAST ONE PARAMETER OF A SUBTERRANEAN BORE

(71) Applicants: James L. Miller, II, Houston, TX (US); Jason Mailand, Houston, TX (US); Elias Pena, Houston, TX (US); James Scott Sanchez, Houston, TX (US); William B. Handy, Houston, TX (US); Christopher Elliott, Houston, TX (US); Daniel Matthews, Houston, TX (US)

(72) Inventors: James L. Miller, II, Houston, TX (US); Jason Mailand, Houston, TX (US); Elias Pena, Houston, TX (US); James Scott Sanchez, Houston, TX (US); William B. Handy, Houston, TX (US); Christopher Elliott, Houston, TX (US); Daniel Matthews, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 617 days.

(21) Appl. No.: 13/772,061

(22) Filed: Feb. 20, 2013

(65) Prior Publication Data

US 2014/0236485 A1 Aug. 21, 2014

(51) Int. Cl.

| | |
|---|---|
| ***E21B 47/12*** | (2012.01) |
| ***E21B 47/00*** | (2012.01) |
| ***E21B 47/01*** | (2012.01) |

(52) U.S. Cl.

CPC ..... *E21B 47/12* (2013.01); *E21B 47/01* (2013.01); *Y10T 29/49819* (2015.01)

(58) Field of Classification Search

CPC ..... E21B 47/01; E21B 43/086; E21B 43/11; E21B 47/12; E21B 49/10

USPC ..... 702/6, 9, 11; 73/152.51; 166/250.01, 166/250.11; 175/41; 250/269.1

See application file for complete search history.

(56) References Cited

U.S. PATENT DOCUMENTS

| | | | |
|---|---|---|---|
| 6,644,411 | B2 | 11/2003 | Compton et al. |
| 2003/0226662 | A1 | 12/2003 | Linyaev et al. |
| 2004/0251048 | A1 | 12/2004 | Kurkoski |
| 2006/0102834 | A1 | 5/2006 | Mickael et al. |
| 2010/0078164 | A1 | 4/2010 | Bostick, III et al. |
| 2010/0139388 | A1 | 6/2010 | Griffiths et al. |

OTHER PUBLICATIONS

Liu and Horne, "Interpreting Pressure and Flow Rate Data from Permanent Downhole Gauges Using Data Mining Approaches"; Society of Petroleum Engineers; Conference Paper SPE147298; 2011; 16 pages.

Liu and Horne, "Interpreting Pressure and Flow-Rate Data From Permanent Downhole Gauges by Use of Data-Mining Approaches"; Society of Petroleum Engineers; Feb. 2013 SPE Journal; 14 pages.

Notification of Transmittal of the International Search Report and the Written Opinion of the International Searching Authority, or the Declaration; PCT/US2014/017363; Jun. 20, 2014; 12 pages.

*Primary Examiner* — John H Lee

(74) *Attorney, Agent, or Firm* — Cantor Colburn LLP

(57) ABSTRACT

A recoverable data acquisition system includes at least a portion of at least one sensor be positionable within a tubular of a completion system, the at least a portion being recoverable therefrom and a retainer movably disposed at the tubular between at least a first position and a second position, a cavity being defined between the tubular and the retainer when the retainer is in the first position, the at least a portion of the at least one sensor being removable from the cavity in response to movement of the retainer from the first position to the second position.

14 Claims, 4 Drawing Sheets

RECOVERABLE DATA ACQUISITION SYSTEM AND METHOD OF SENSING AT LEAST ONE PARAMETER OF A SUBTERRANEAN BORE

BACKGROUND

Data Acquisition Devices (DAD's) typically include sensors that are deployed via wireline, slickline or permanently attached to a tubular, casing or liner system with feed through packers, using control line or fiber optic cable to monitor a variety of parameters, such as temperature, pressure, fluid resistivity and flow rates, for example. Deploying such DAD's in this manner is difficult, expensive and can experience issues that prevent their successful deployment in horizontal wells. Systems and methods to alleviate the foregoing concerns are therefore of interest to those practicing in the art.

BRIEF DESCRIPTION

Disclosed herein is a recoverable data acquisition system. The system includes at least one sensor positionable within a tubular of a completion system that is recoverable therefrom.

Further disclosed herein is a method of sensing at least one parameter of a subterranean bore. The method includes positioning at least one sensor within a tubular, miming the tubular into the subterranean bore, completing the subterranean bore, sensing at least one parameter with the at least one sensor and recovering at least a portion of the at least one sensor.

Further disclosed herein is a method of recovering at least one sensor from a completion data acquisition system. The method includes running into a tubular of a completion, shifting at least one retainer defining a cavity between the retainer and the tubular, ejecting at least one sensor from the cavity, catching the at least one sensor and recovering the sensor while running out of the tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
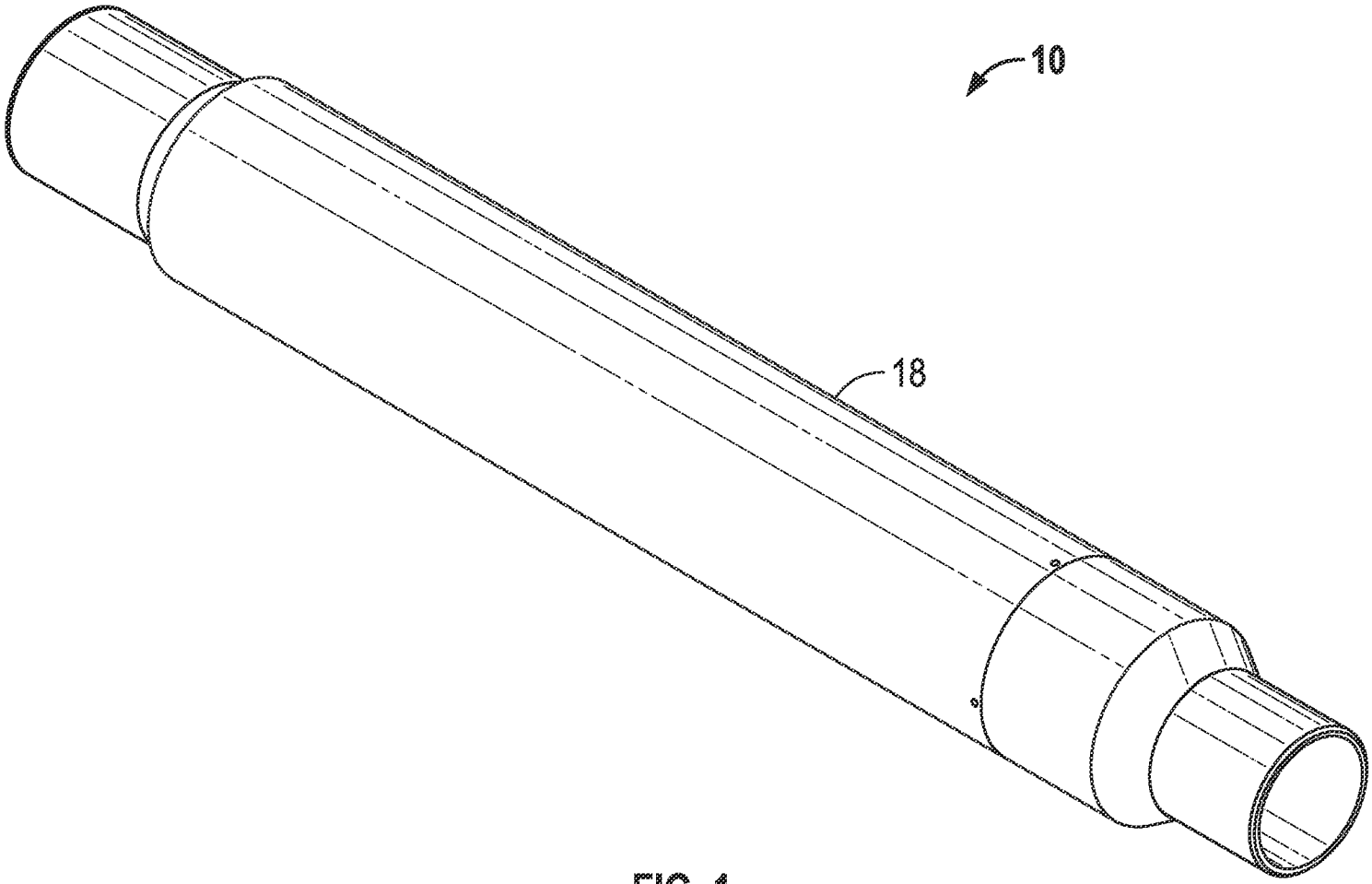
FIG. 1 depicts a perspective view of a recoverable data acquisition system disclosed herein.
Figure 2:
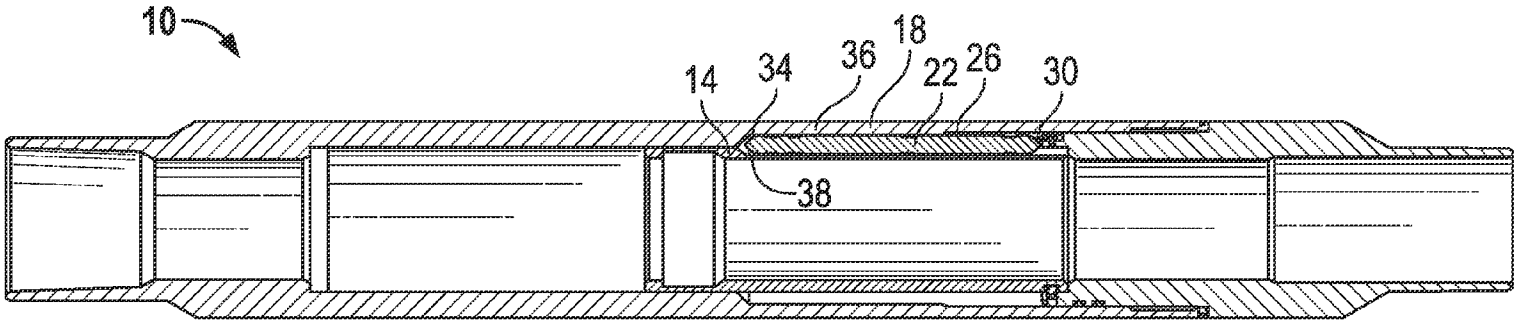
FIG. 2 depicts a cross sectional view of the recoverable data acquisition system of FIG. 1 in a first position.
Figure 3:
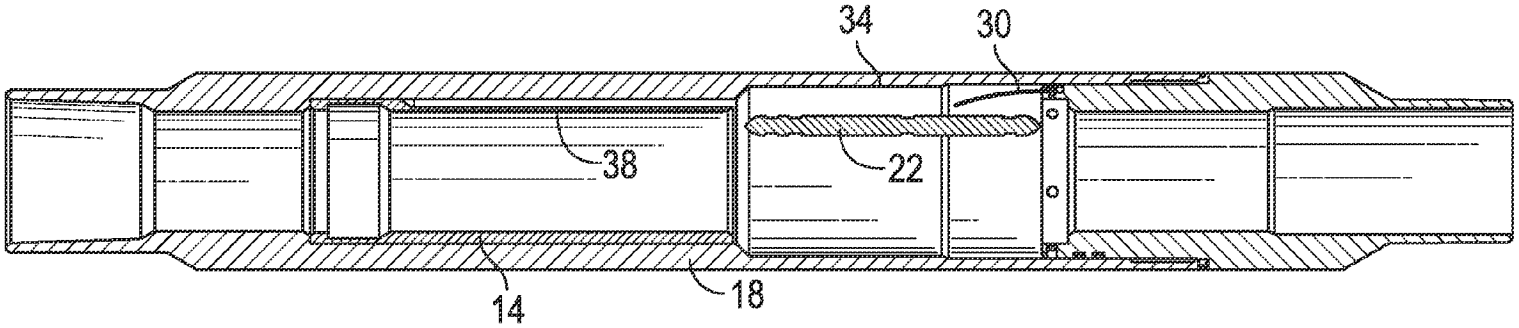
FIG. 3 depicts a cross sectional view of the recoverable data acquisition system of FIG. 1 in a second position.
Figure 4:
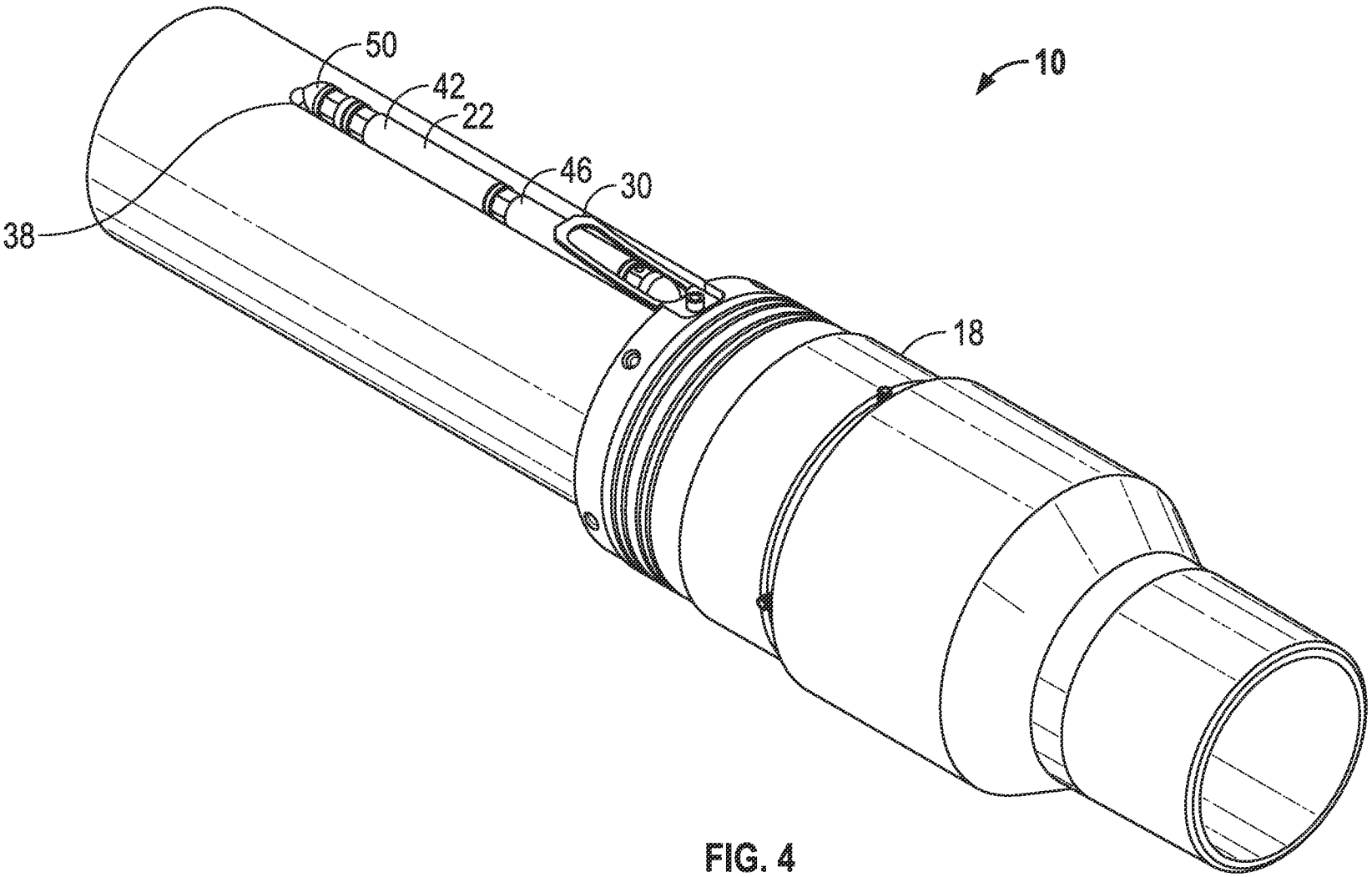
FIG. 4 depicts a perspective view of the recoverable data acquisition system of FIG. 1 with a portion of the tubular removed.

Referring to FIGS. 1-4 an embodiment of a recoverable data acquisition system disclosed herein is illustrated at 10. The recoverable data acquisition system 10 includes at least one sensor 22, with a single sensor 22 being illustrated in this embodiment, positionable within a tubular 18 of a subterranean bore referred to herein as a completion system that is recoverable therefrom for retrieval of data acquired thereby. The tubular 18 may be a liner, casing or other completion component attachable to one of the former. The system 10 further includes a retainer 14, movably disposed at the tubular 18 between a first position (as shown in FIG. 2) and a second position (as shown in FIG. 3). The sensor 22 is maintained within a cavity 26 defined between the retainer 14 and the tubular 18 when the retainer 14 is in the first position. A biasing member 30, shown herein as a leaf spring, biases the sensor 22 out of the cavity 26 when the retainer 14 is moved to the second position. The foregoing structure allows an operator of the system 10 to recover the sensor 22 after a selected time to retrieve data acquired thereby.

In this embodiment the cavity 26 is formed in part by a recess 34 in a wall 36 of the tubular 18 and in part by a groove 38 in the retainer 14. In other embodiments, one of which will be described in detail hereunder, the cavity 26 can be formed completely in the retainer 14 or the tubular 18. In this embodiment, the biasing member 30 is attached to the tubular 18 and urges the sensor 22 radially inwardly to eject the sensor 22 from the cavity 26 as the retainer 14 is moved to the second position.

The sensor 22 can include one or more sensors for measuring parameters such as pressure, temperature, flow, capacitance, resistivity, magnetic resonance, gravity, acoustic, nuclear and any combinations of the foregoing, for example. Additionally, the sensor 22 can include portions such as a battery 42 for powering the sensor 22 and a memory module 46 for storing data gathered by the sensor 22 for later retrieval. Optionally, the sensor 22 could include a wireless transceiver 50 (FIG. 4) for receiving and transmitting data to and from a remote location including to other sensors 22 in other recoverable data acquisition systems 10, for example.

Figure 5:
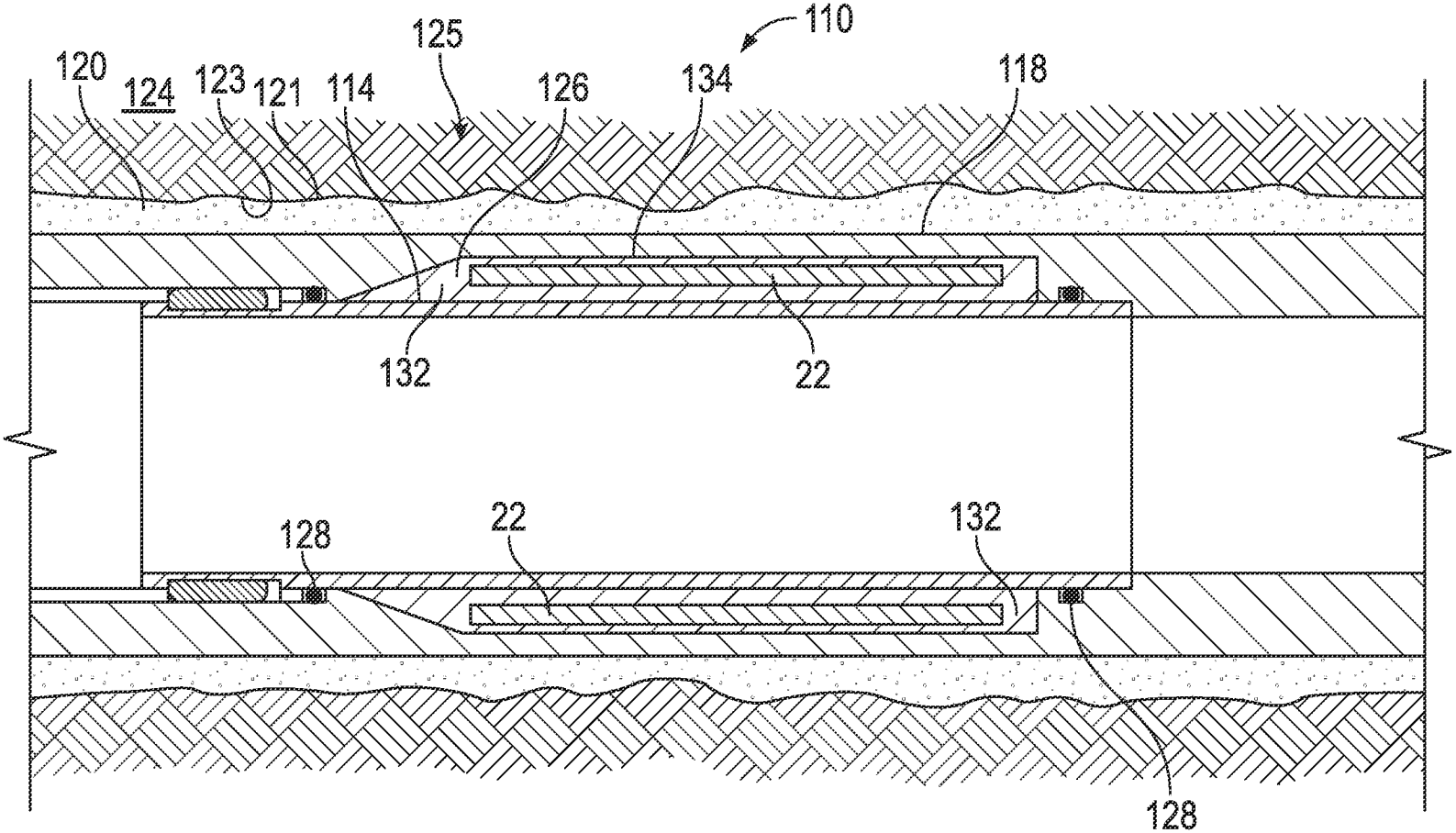
FIG. 5 depicts a cross sectional view of an alternate embodiment of a recoverable data acquisition system disclosed herein.

Referring to FIG. 5, an alternate embodiment of a recoverable data acquisition system disclosed herein is illustrated at 110. The Figure illustrates two of the systems 110 oriented perimetrically opposite to one another. As with the system 10 the system 110 employs a retainer 114 movably engaged with a tubular 118 and is illustrated only in the first or the closed position. Cement 120 is positioned within an annulus 121 between the tubular 118 and an open borehole 123 in an earth formation 124, thereby defining a completion 125. It should be noted that alternate embodiments could include completions that are not cemented.

The system 110 includes a cavity 126 defined between the retainer 114 and the tubular 118 for housing the sensor 22. The cavity 126, however, differs from the cavity 26 in that the cavity 126 is formed completely within a recess 134 in a tubular 118, thereby negating the need for the groove 38 as is used in the retainer 14 of the system 10. Alternate embodiments could have a cavity formed completely by a groove in the retainer (not shown) thereby negating the need for the recess 134 in the tubular 118.

The system 110 optionally employs seals 128, shown herein as o-rings that slidingly sealingly engage the retainer 114 to the tubular 118 on opposing longitudinal sides of the cavity 126 when the retainer 114 is in the first position thereby enclosing the cavity 126 and maintaining the sensor 22 therewithin in a fluid tight space. The seals 128 can prevent fluid intrusion into the cavity 126 as well as prevent pressure outside of the cavity 126 from being experienced within the cavity 126. By isolating the sensor 22 from an environment outside of the cavity 126 the system 110 can protect the sensor 22 from otherwise damaging conditions. For example, the sensor 22 can be protected from erosion due to high flow rates through the tubular 118. Although not shown in the Figures, the system 10 may optionally incorporate the seals 128, or seals of another configuration, to isolate the cavity 26 from an environment outside thereof.

Optionally, in either of the systems 10 or 110, the cavities 26 or 126 may also be fillable with a disintegrable material 132 (only shown in FIG. 5), that softens when exposed to a fluid. The disintegrable material 132 can be configured to encase the sensor 22 thereby isolating the sensor 22 from fluids and pressures surrounding the disintegrable material 132. The disintegrable material 132 can work in concert with the sealable cavity 126 to provide redundant protection against exposure of the sensor 22 to environmental conditions outside of the cavity 126. Or the disintegrable material 132 can provide complementary protection to the sensor 22. One example of this being in embodiments wherein the disintegrable material 132 provides structural support to one or both of the retainer 114 and the tubular 118 during high pressure conditions, while relying on the sealing of the seals 128 to prevent fluid exposure of the sensor 22 and of the disintegrable material 132. In this scenario the structural support provided by the disintegrable material 132 is maintained until the retainer 114 is moved to the second position and the disintegrable material 132 has been exposed to a fluid for a period of time thereby causing dissolution thereof.

The disintegrable material 132 can be made of a high strength controlled electrolytic metallic material and be disintegrable when exposed to a fluid referred to herein as an activation fluid. Possible activation fluids include brine, acid, aqueous solutions or combinations of one or more of these, for example. A variety of suitable materials for use as the disintegrable material and their methods of manufacture are described in United States Patent Publication No. 2011/0135953 (Xu et al.), the entire Patent Publication of which is hereby incorporated by reference in its entirety.

One or more of each or both of the systems 10 and 110 can be employed at the same time. Doing so would allow an operator to monitor conditions with one or more of the systems 10, 110 prior to an operation such as fracing, for example, and then to monitor conditions with one or more others of the systems 10, 110 after the fracing operation is complete. The system 10, 110 to be used after the fracing would protect the sensor from the environment during fracing while then allowing the system 10, 110 to monitor conditions after the fracing. The sensor 22 can be configured wait a selected time before beginning acquiring data or can wait until specific threshold conditions are met before beginning acquiring data.

Employing one or more of the systems 10, 110 in a completion allows an operator to perform several operations in a single run. For example, plugs, and other devices that are no longer needed can be drilled out and then one or more of the retainers 14 can be shifted to the second (open) position thereby allowing the sensors 22 to be ejected from the cavities 26, 126. A recovery basket can catch all the ejected sensors 22 during the trip out thereby recovering them for subsequent retrieval of any data they may have acquired.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A recoverable data acquisition system comprising at least a portion of at least one sensor positionable within a tubular of a completion system and being recoverable therefrom separately from the tubular, a retainer movably disposed at the tubular between at least a first position and a second position, a cavity being defined between the tubular and the retainer when the retainer is in the first position, the at least a portion of the at least one sensor being removable from the cavity in response to movement of the retainer from the first position to the second position.

2. The recoverable data acquisition system of claim 1, wherein the tubular is a liner or casing or a collar.

3. The recoverable data acquisition system of claim 1, wherein the at least a portion of the at least one sensor is recoverable after completion.

4. The recoverable data acquisition system of claim 1, wherein the at least a portion of the at least one sensor is recoverable after cementing.

5. The recoverable data acquisition system of claim 1, wherein the at least one sensor is activated due to a threshold condition being experienced.

6. The recoverable data acquisition system of claim 1, wherein the recovery of the at least a portion of the at least one sensor is from an earth formation borehole.

7. The recoverable data acquisition system of claim 1, wherein a portion of the cavity is formed by a recess in a wall of the tubular and a portion of the cavity is formed by a groove in the retainer.

8. The recoverable data acquisition system of claim 1, wherein the cavity is formed completely within one of a recess in a wall of the tubular and a groove in the retainer.

9. The recoverable data acquisition system of claim 1, further comprising a biasing member configured to urge the at least a portion of the at least one sensor away from at least one of the tubular and the retainer when the retainer is moved toward the second position.

10. The recoverable data acquisition system of claim 1, further comprising a disintegrable material positioned within the cavity configured to isolate the sensor from an environment external to the cavity regardless of whether the retainer is in the first position or the second position until degradation of the disintegrable material.

11. The recoverable data acquisition system of claim 10, wherein the disintegrable material is a controlled electrolytic metallic material.

12. The recoverable data acquisition system of claim 10, wherein the disintegrable material is configured to degrade upon exposure to an activation fluid.

13. The recoverable data acquisition system of claim 1, wherein the at least one sensor is configured to measure one or more of pressure, temperature, flow, capacitance, resistivity, magnetic resonance, gravity, acoustic, nuclear and combinations of two or more of the aforementioned.

14. The recoverable data acquisition system of claim 1, wherein the at least a portion of the at least one sensor includes one or more of a memory module a battery and a transceiver and combinations thereof.

* * * * *